United States Patent [19]

Villa et al.

[11] Patent Number: 4,646,792

[45] Date of Patent: Mar. 3, 1987

[54] DEVICE FOR SUPPLYING AND REGULATING A THREAD FOR A TEXTILE MACHINE, PARTICULARLY A LOOM

[75] Inventors: Carlo Villa, Melzo, Italy; Francisco Speich, Gipf-Oberfrick, Switzerland

[73] Assignee: Textilma AG

[21] Appl. No.: 720,413

[22] PCT Filed: Jul. 24, 1984

[86] PCT No.: PCT/CH84/00116

§ 371 Date: Mar. 22, 1985

§ 102(e) Date: Mar. 22, 1985

[87] PCT Pub. No.: WO85/00625

PCT Pub. Date: Feb. 14, 1985

[30] Foreign Application Priority Data

Jul. 25, 1983 [CH] Switzerland ..... 4052/83

[51] Int. Cl.[4] ..... D03D 47/34

[52] U.S. Cl. ..... 139/452

[58] Field of Search ..... 139/452, 450; 242/47.01, 47.12, 47.13; 66/125, 146, 132 R

[56] References Cited

U.S. PATENT DOCUMENTS

| | | | |
|---|---|---|---|
| 3,194,276 | 7/1965 | Krukonis | 139/452 |
| 3,460,584 | 8/1969 | Mosher | 139/452 |

FOREIGN PATENT DOCUMENTS

| | | | |
|---|---|---|---|
| 2352906 | 12/1977 | France | 139/450 |
| 2039547 | 8/1980 | United Kingdom | 139/450 |
| 2078792 | 1/1982 | United Kingdom | 139/450 |

*Primary Examiner*—Henry S. Jaudon

*Attorney, Agent, or Firm*—Toren McGeady Goldberg

[57] ABSTRACT

A device for supply and control of a thread for a textile machine includes a thread conveying roller continuously driven at constant speed and conveying depending on the thread tension, a flexibly retained movable first thread guidance loop arranged at the outlet side of the thread conveying roller, a spring for biasing the first thread guidance roller, and a second thread guidance loop arranged on the side of the thread conveyance roller which faces away from the first thread conveyance loop. Instead of the second thread guidance loop, a fixed thread guidance loop defining a guidance aperture may be provided. The device for supplying and regulating a thread is intended particularly for a loom and has the advantage that it is of simple construction and makes possible a jerkless thread conveyance.

12 Claims, 10 Drawing Figures

Figure 1:
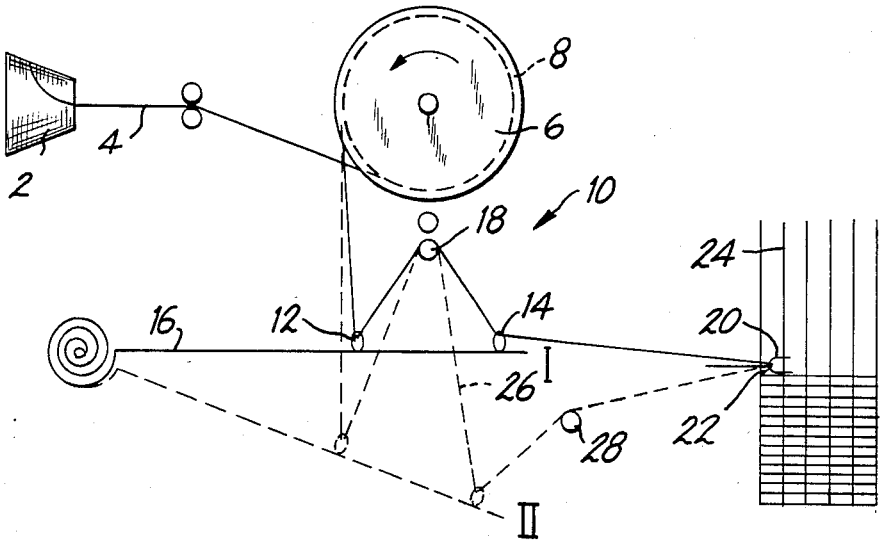

DEVICE FOR SUPPLYING AND REGULATING A THREAD FOR A TEXTILE MACHINE, PARTICULARLY A LOOM

The invention is directed to a device for supply and regulation of a thread for a textile machine, in particular a loom.

Devices of the previously mentioned type are variously known, as for instance from the DE-OS 30 01 069. The thread control devices described there comprise a spring clip containing a thread guidance loop, which in a first position releases a thread and in a second position introduces same into a clamping device consisting of an elastic element, which forms a tapering gap together with a fixed machine part. Thereby it is very disadvantageous, that the thread clamped in the tapering gap can be damaged at the beginning of the thread conveyance both during the clamping, as during the loosening through the chafing of the thread in the gap. Apart from that an increased initial effort is required for the loosening of the thread in the clamping device, which leads to a jerky release of the thread from the clamping device, whereby extreme tensile fluctuations arise in the thread, which on the one side can influence the uniformity of the textile product to be fabricated in a damaging fashion or can even lead to rupture of the thread. These disadvantages are in part avoided by means of a further embodiment form of the device according to the DE-OS No. 30 01 069, in which the thread control device comprises a thread guidance loop arranged on a lever, which is mechanically connected to a displaceable brake shoe, which coacts with a fixed brake shoe. The thread is guided in between the brake shoes. In a first position the brake shoe releases the thread conveyance and in a second position it tightly clamps the thread. With this device damage to the thread during clamping and loosening is avoided, however the device is relatively complicated and it is impossible to avoid a starting run of the thread without jerks. Apart from that the device for both embodiment examples shows a thread clamping device, which is located in front of the thread conveyance roller.

It is a task of the invention to create a device of the previously described type in such a manner, that on the one hand a jerkless thread conveyance is possible and on the other hand the device has a simple construction.

The defined task is solved by the present invention. Since in the inventive case the thread control device effectuates the conveying of the thread exclusively on the basis of the position of the thread guidance loop and the frictional behavior in the thread control device or at the thread conveyance roller, it is possible to do without active thread brake devices and the thread control device can be located directly behind the thread conveyance roller. This results in a considerably simplified construction of the device. Over and above that this design makes possible in particular a very smooth control of the thread conveyance, which directly adjusts to the requirements and where no tensile fluctuations occur, as they would be caused by the additional active braking device. Thus a thread conveyance results which adjusts optimally to the requirements of the loom. Additionally, it is possible by means of the two loops, which are formed over the fixed thread guidance and the two thread guidance loops, to form a larger thread reserve in the smallest space. Finally, this design makes possible in a simple manner the arrangement of additional fixed thread guides, whereby the frictional resistance can be further changed.

Of advantage is also an embodiment additional fixed thread guidance or thread guidance loop, which becomes operative in the second position of the displaceable thread guidance loop, however not in the first position, an additional frictional resistance can be generated, which is desirable in the second position of the thread guidance loop. In the first position of the thread loop, in which the thread must be conveyed, this additional frictional resistance does not appear.

If the guidance loop is not sufficient in order to interrupt the thread conveyance at the thread conveyance roller in the second position, a second thread guidance loop is advantageous. The feeding of the thread reserve is fruther facilitated if the second loop is arranged as a spring loop.

A very simple design of the thread guidance loop a design is also possible, whereby then the higher frictional behavior in the II position is achieved by an additional wraparound, which ensues from a twisting of the thread guidance loop. A further influencing of the frictional behavior here is made possible by a frictional coating. The feed of the thread into the guidance area of higher frictional properties is favorized if the thread guidance loop is inclined in conveyance direction of the thread.

The fixed thread guidance loop can preferably be arranged directly at the outlet side of the thread conveyance roller.

Figure 2:
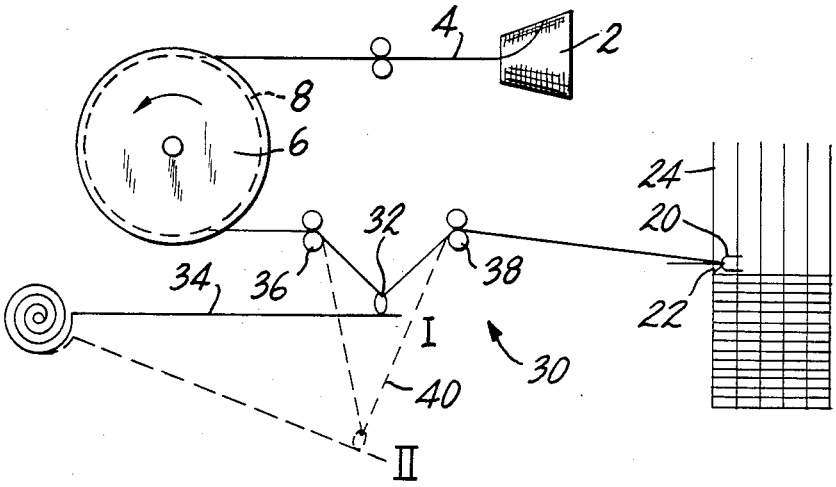
Figure 3:
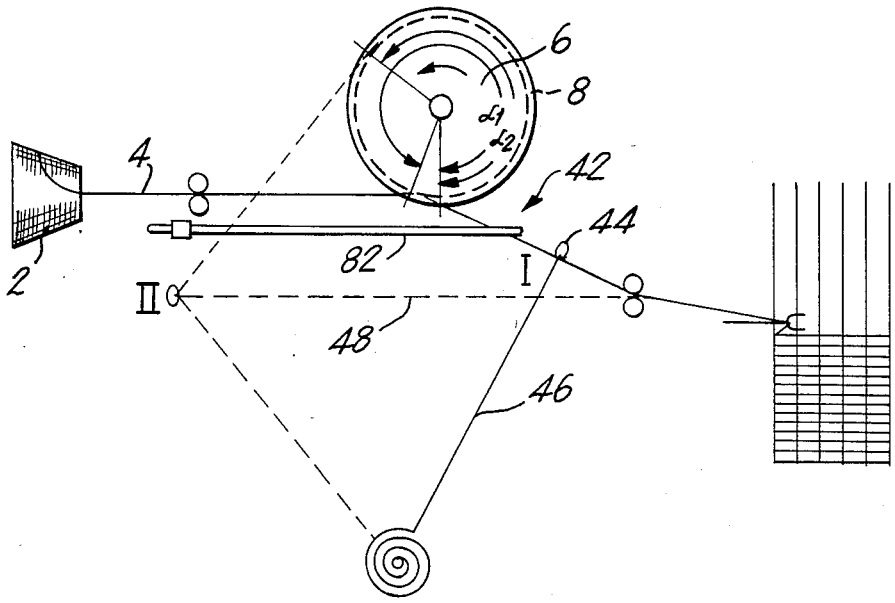
Figure 4:
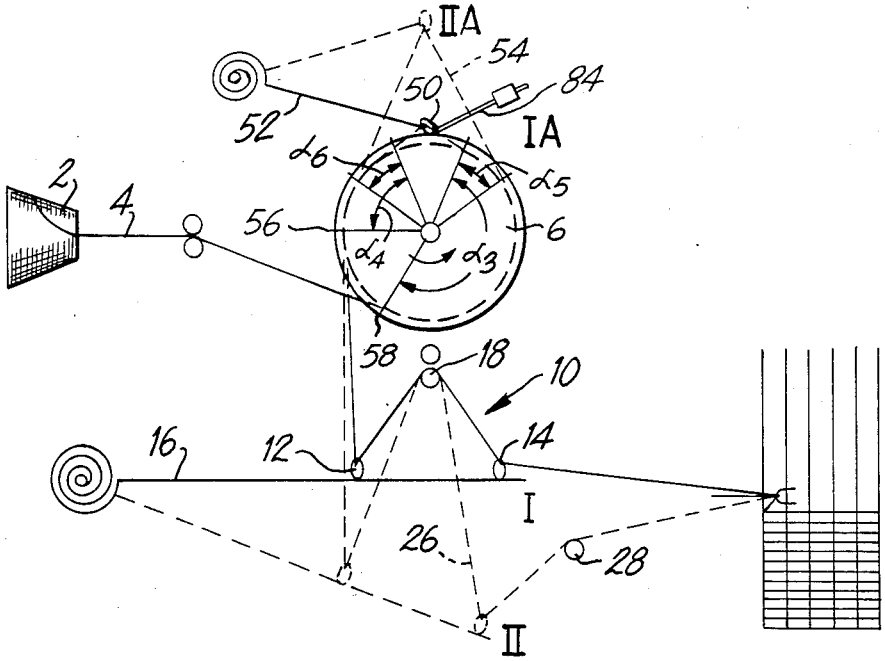
Figure 5:
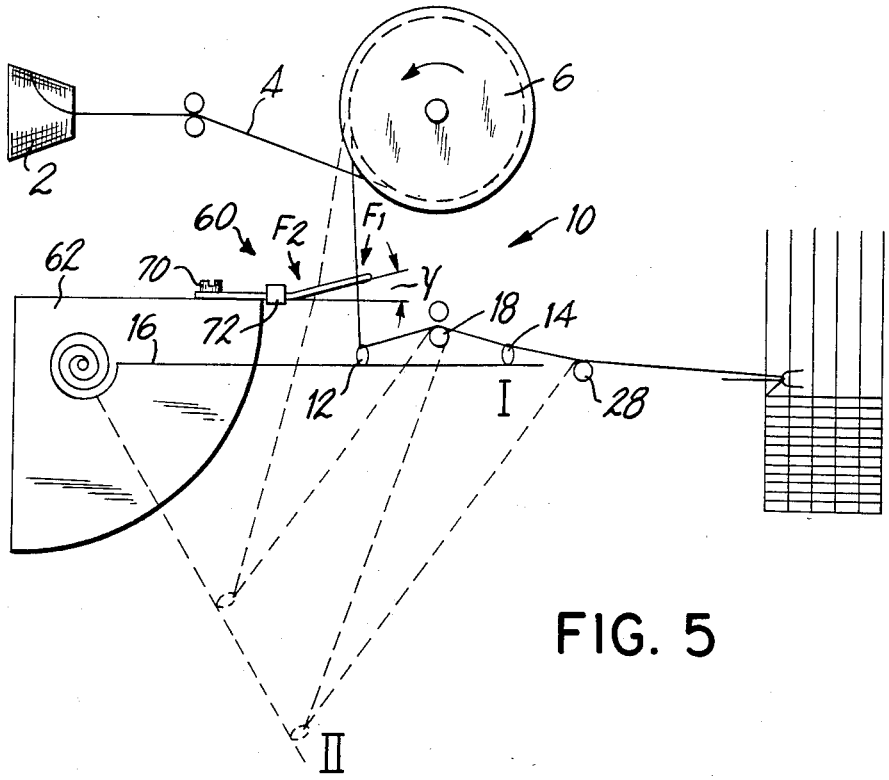
Figure 6:
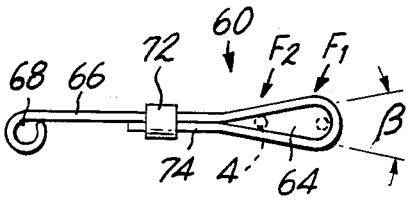
Figure 7:
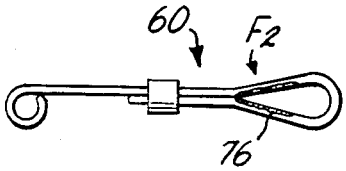
Figure 8:
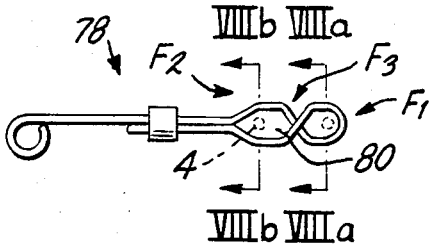
Figure 8B:
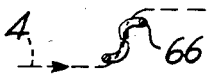
Figure 8A:
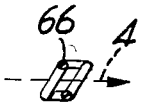

Embodiment examples of the inventive device are described in greater detail in the following with the help of schematic drawings, hereby it is shown on:

FIG. 1 a thread conveyance device with a thread guidance device, which comprises two movable thread guidance loops; FIG. 2 a thread conveyance device with a thread guidance device, which comprises one movable thread guidance loop;

FIG. 3 a thread conveyance device with one thread guidance device, whose thread guidance loop influences the wrapping angle at the thread conveyance roller;

FIG. 4 the thread conveyance device according to FIG. 1 with a second thread guidance loop, which influences the wrapping angle at the thread conveyance roller;

FIG. 5 the thread conveyance device according to FIG. 1 with an additional fixed thread guidance loop;

FIG. 6 the fixed thread guidance loop in FIG. 5 in plan view;

FIG. 7 the thread guidance loop in FIG. 6 with an additional friction coating;

FIG. 8 a further fixed thread guidance loop with a twisted loop portion in plan view; and FIGS. 8*a* and 8*b* the sections VIII*a*—VIIID*a* and VIII*b*—VII*b* and through the guidance loop of FIG. 8.

The FIG. 1 shows a first type of thread guidance in a textile machine, preferably an indicated ribbon loom. A thread 4 extends from a supply coil 2 to a thread conveyance roller 6, which is driven continuously. The thread conveyance roller 6 comprises a revolving groove 8, in which the thread 4 wraps around the thread conveyance roller 6. A succeeding thread guidance device 10 takes over the thread 4 from the thread conveyance roller 6. The thread guidance device 10 comprises two thread guidance loops 12, 14, which are arranged at a spring clip 16, so that they are retained in an elastic manner. Between the thread guidance loops 12,14 the thread 4 is laid over a fixed thread guidance 18. The thread leaving the thread guidance loop 14 is guided to a filling thread inserting element 20, which inserts filling thread loops 22 into the warp compartment of a ribbon loom which is formed by the warp threads 24.

In the first postion I shown in FIG. 1 the thread guidance loops 12, 14 show a small distance to the fixed thread guidance 18. In this position the prestressing force of the spring clip 16 is larger than in the second position II, which is indicated by dots and in which the thread guidance loops 12, 14 exhibit a larger distance from the thread guidance 18. In this second position the thread guidance device 10 forms a thread reserve 26 and the thread being fed rests at an additional fixed thread guidance 28, which can be equipped with a frictional layer.

In the depicted functional phase the filling thread inserting element inserts a filling thread loop 22 into the warp compartment, whereby a higher thread stress is applied to the thread guidance device 10, so that the spring clip 16 is tensioned and the thread guidance loops 12, 14 assume the first position I. This increased thread stress extends to the thread conveyance roller 6, so that the thread 4 is brought to rest on it and the thread conveyance roller 6 by means of the frictional engagement of the thread 4 pulls the thread from the reserve coil 2 and feeds it to the thread control device 10. After the filling thread loop 22 has been inserted into the warp compartment, the filling thread 22 is tied in a known manner to the fabric edge and the filling thread inserting element 20 moves back from the warp compartment, whereby no thread conveyance occurs. Since the thread conveyance roller 6 however continues to run, the thread reserve 26 is formed in the thread control device and thereby the spring clip 16 is unloaded onto the second position II, in which the initial stress is so small, that it is no longer sufficient, in order to cause a frictional engagement required for thread conveyance at the thread conveyance roller 6. The thread conveyance roller 6 rotates in an idling mode. If the filling thread inserting element 20 again moves in direction of the warp compartment, then the thread reserve 26 is used up and the spring clip 16 is tensioned to an extent until a renewed thread conveyance occurs. Since the transitions of the individual thread conveyance phases are progressive, a very smooth and gentle thread conveyance results, which, however, supplies the stress required for the insertion of the filling thread loop.

The thread conveyance device depicted in FIG. 2 differs only by an alternate thread control device 30, so that the same parts are given the same reference numbers as in FIG. 1. . The thread control device 30 comprises only one thread guidance loop 32 at a spring clip 34, which guides the thread 4 in between two fixed thread guides 36, 38 and forms the thread reserve 40. Here also the first position I of the spring clip 34 with the thread guidance loop 32 is shown in solid lines and the second position II is shown in dotted lines.

The functional mode of the thread conveyance device in FIG. 2 corresponds to that in FIG. 1, so that we refer to the statements in that connection.

The thread conveyance device in FIG. 3 differs from the previous thread conveyance devices of the FIGS. 1 and 2 by a further modified thread control device 42. This last-mentioned one comprises only one thread guidance loop 44 at a spring clip 46. In the first position I the thread 4 and the spring clip 46 are under tension for the thread conveyance. The thread guidance loop 44 assumes a position, in which a large wrapping angle $\alpha_1$ for the thread conveyance at the thread conveyance roller 6 is achieved. In the second position II shown in dotted lines the thread guidance loop 44 forms a thread reserve 48 and reduces the wrapping angle onto a smaller value $\alpha_2$, with which together with a smaller thread tension the frictional engagement of the thread 4 at the thread conveyance roller 6 is no longer sufficient in order to cause a thread conveyance.

FIG. 4 shows a refinement of the thread conveyance device in FIG. 1, whereby the thread control device 10 comprises in addition to the first thread guidance loop 12, 14 a second thread guidance loop 50 which is arranged at that side of the thread conveyance roller 6 which faces away from the first thread guidance loops 12, 14. This second thread guidance loop is attached at a spring clip 52, with which the second thread guidance loop 50 is prestressed in a direction facing away from the thread conveyance roller 6. In the first position of the first thread guidance loops 12, 14 the second thread guidance loop 50 assumes also a first position IA, in which it is located close to the periphery of the thread conveyance roller 6 and thus forms the largest wrapping angle $\alpha_3$ and $\alpha_4$. If the thread conveyance in the second position II of the first thread guidance loops 12, 14 is not arrested, then the second thread guidance loop 50 moves into the second position IIA under the influence of the spring clip 52 while forming another thread reserve 54. In this last position the wrapping angle is reduced by the values $\alpha_5$ and $\alpha_6$, so that the frictiohal engagement at the thread conveyance roller 6 is reduced so far, that the thread conveyance is interrupted. The functional mode of the second thread guidance loop 50 is facilitated, if it is arranged nearer to the winding off spot 56 than to the winding on spot 58 of the thread 4 at the thread conveyance roller 6.

This additional equipment of the thread control device with a second thread guidance loop according to the embodiment example in FIG. 4 can also be applied in the thread conveyance devices in the FIGS. 2 and 3.

FIG. 5 depicts a thread conveyance device according to FIG. 1 which has been further refined. The same parts are therefore given the same reference numbers as in FIG. 1. By way of complementation of the embodiment according to FIG. 1, the thread conveyance device is given an additional fixed thread guidance loop 60, which is located in between the thread conveyance roller 6 and the movable thread guidance loop 12 at the machine frame 62. As can be in particular seen from FIG. 6, the thread guidance loop 60 comprises two guidance areas F1 and F2 with differing frictional properties. In the first position I of the movable thread guidance loop 12 the thread 4 is contained in the guidance area F1 with low frictional properties and in the second position II of the movable thread guidance loop 12 in the guidance area F2 with higher frictional properties. If no thread is pulled off at the consuming spot, meaning by the filling thread inserting element 20, then the thread guidance loop 12 guides the thread 4 from the guidance area F1 into the guidance area F2, whereby the thread conveyance at the fixed thread guidance loop 60 is rendered more difficult and the thread conveyance roller 6 which continues to rotate is unloaded of the thread stress. It is particularly appropriate if the fixed thread guidance loop 60 narrows in the direction of the guidance area F2 of the guidance aperture 64 and thereby forms an aperture angle $\beta$ which is preferably smaller than 20°. It is furthermore advantageous if the fixed thread guidance loop 60 is inclined in conveyance direction of the thread 4 against the guidance area F2 of higher frictional properties at an inclination angle $\gamma$, as is seen from FIG. 5. The fixed thread guidance loop 60 consists preferably of a bent wire 66. The thread guidance loop 60 comprises an attachment loop 68, by means of which it is attached at the machine frame 62 with a screw 60. A splice strip 72 retains tightly the free wire end 74, which has formed the guidance aperture 64.

FIG. 7 depicts the fixed thread guidance loop of the FIG. 6 with an additional frictional coating 76 in the thread conveyance area F2, which has an increased frictional behavior.

The FIGS. 8, 8*a* and 8*b* depict a further thread guidance loop 78, from a wire 66, which forms the guidance aperture 80. The wire 66 is twisted by 180° at the transitional area F3 between the guidance areas F1 and F2 of differing frictional properties. In the guidance area F1 the thread 4 is guided simply, as is seen from the section of the FIG. 8*a*. In the guidance area F2 however the thread is guided in an S-shaped fashion because of the twisting, as is seen from FIG. 8*b*, whereby an increase in the frictional resistance results.

A fixed guidance loop with guidance areas of differing friction properties of the previously mentioned type can also be arranged in the remaining embodiment examples, as this is for instance indicated for the thread guidance loop 82 in the example in FIG. 3 and the thread guidance loop 84 in the example in the FIG. 4.

Listing of Reference Numbers $\alpha$ Wrapping angle at 6
$\beta$ Aperture angle of 64
$\gamma$ Angle of inclination
F1 Guidance area
F2 Guidance area
F3 Transitional area
2 Reserve coil
4 Thread
6 Thread conveyance roller
8 Groove
10 Thread guidance device
12 Thread guidance loop
14 Thread guidance loop
16 Spring clip
18 Thread guidance
20 Filling thread inserting element
22 Filling thread loop
24 Warp thread
26 Thread reserve
28 Thread guidance
30 Thread control device
32 Thread guidance loop
34 Spring clip
36 Thread guidance
38 Thread guidance
40 Thread reserve
42 Thread control device
44 Thread guidance loop
46 Spring clip
48 Reserve
50 Second thread guidance loop
52 Spring clip
54 Thread reserve
56 Winding off spot of 4 at 6
58 Winding on spot of 4 at 6
60 Thread guidance loop
62 Machine frame
64 Guidance aperture
66 Wire
68 Attachment loop
70 Screw
72 Splice strip
74 Free wire end
76 Friction coating
78 Thread guidance loop
80 Guidance aperture
82 Thread guidance loop in FIG. 3
84 Thread guidance loop in FIG. 4

We claim:

1. Device for supply and control of a thread for a textile machine, comprising a thread conveying roller continuously driven at constant speed and conveying depending on the thread tension, a flexibly retained movable first thread guidance loop arranged at the outlet side of the thread conveying roller, a spring for biasing the first thread guidance loop, the first thread guidance loop in a first position under greater spring tension releasing the thread conveyance and in a second position under lesser spring tension interrupting the conveyance, the flexible retained first thread guidance loop (12,14) in the first position (1) causing a larger first wrapping angle ($\alpha_1$) making possible a thread conveyance and in the second position (II), while forming a thread reserve (48), causing a smaller first wrapping angle ($\alpha_2$) interrupting the conveyance of the thread (4) with the thread conveyance roller (6), a second thread guidance loop (50) arranged on the side of the thread conveyance roller (6) which faces away from the first thread loop (12, 14) and is biased by means of a spring (52) in a direction away from thread conveyance roller (6), so that the second thread guidance loop (50) in the first position (I) of the first thread guidance loop (12,14) takes up a first position (IA) near the periphery of the thread conveyance roller (6) causing a larger second wrapping angle and in the second position (II) of the first thread guidance loop (12, 14) takes up a second position (IIA) with a radial distance from the periphery of the thread conveyance roller (6) causing a smaller second wrapping angle.

2. Device according to claim 1, wherein the second thread guidance loop (50) is arranged on a spring clip (52).

3. Device according to claim 1, wherein the thread (4) is conducted onto the thread conveyance roller (6) at a winding on place (58) and is released from the thread conveyance roller (6) at a winding off place (56), and wherein the second thread guidance loop (50) is arranged nearer to the winding off place (56) than the winding on place (58) of the thread (4).

4. Device according to the claim 1, wherein comprising a fixed thread guidance loop (84) associated with the additional movable second thread conveyance loop (50).

5. Device for supplying and regulating a thread for a textile machine, comprising a thread conveying roller continuously driven at constant speed and conveying depending on the thread tension, a thread control device with a flexibly retained movable thread guidance loop arranged at the outlet side of the thread conveying roller, the thread guidance loop biased by a spring, the thread guidance loop in a first position under greater spring tension releasing a thread conveyance by means of the thread conveyance roller and in a second position under lesser spring tension interrupting the conveyance, at least one fixed thread guiding means (18, 36, 38) is associated with the flexibly retained thread guidance loop (12, 14, 32), wherein the thread guidance loop (12, 14, 32) has in a first position (1) a smaller distance and in a second position (II), while forming a thread reserve (26, 40), a greater distance from the fixed thread guiding means (18, 36, 38), and wherein the frictional resistance of the thread (4) in the thread control device (10, 30) in the second position (II) of the thread guidance loop (12, 14, 32) is greater than the thread tension of the thread being wound off, and the thread tension in the first position (I) is smaller than the thread tension required for thread conveyance for the thread conveyance roller (6), the thread control device (10, 42) including a fixed thread guidance loop (60, 78, 82, 84) defining a guidance aperture (64, 80) having at least two guidance areas (F1, F2) of differing frictional properties, wherein the thread (4) is placed in the guidance area (F1) with lower frictional properties when the movable thread guidance loop (12) is in the first position (I) and the thread (4) is placed in the guidance area (F2) with higher frictional properties when the thread guidance loop (12) is in the second position (II).

6. Device for supply and control of a thread for a textile machine, comprising a thread conveying roller continuously driven at constant speed and conveying depending on the thread tension, a flexibly retained movable first thread guidance loop arranged at the outlet side of the thread conveying roller, a spring for biasing the first thread guidance loop, the first thread guidance loop in a first position under greater spring tension releasing the thread conveyance and in a second position under lesser spring tension interrupting the conveyance, the flexibly retained first thread guidance loop (12, 14) in the first position (I) causing a larger wrapping angle ($\alpha_1$) making possible a thread conveyance and in the second position (II), while forming a thread reserve (48), causing a smaller wrapping angle ($\alpha_2$) interrupting the conveyance of the thread (4) with the thread conveyance roller (6), the thread control device (10, 42) including a fixed thread guidance loop (60, 78, 82, 84) defining a guidance aperture (64, 80) having at least two guidance areas (FI, F2) of differing frictional properties, wherein the thread (4) is placed in the guidance area (F1) with lower frictional properties when the movable thread guidance loop (12) is in the first position (I) and the thread (4) is placed in the guidance area (F2) with higher frictional properties when the thread guidance loop (12) is in the second position (II).

7. Device according to claim 5 or 6, wherein the fixed thread guidance loop (60) exhibits a guidance aperture (64) which narrows in the direction of the thread guidance area (F2) with higher frictional properties.

8. Device according to claim 7, wherein the aperture angle ($\beta$) is smaller than 20°.

9. Device according to claim 5 or 6, wherein the fixed thread guidance loop (78) is formed from a wire (66), whereby the thread guidance loop is twisted by 180° in between the guidance areas (F1, F2) with differing frictional properties.

10. Device according to claim 5 or 6, wherein the fixed thread guidance loop (60) is provided with a frictional coating (76) in the guidance area (F2) with higher frictional properties.

11. Device according to claim 5 or 6, wherein the fixed thread guidance loop (60) is inclined at an inclination angle ($\gamma$) in conveyance direction of the thread (4) with respect to the guidance area (F2) with higher frictional properties.

12. Device according to claim 5 or 6, wherein the thread guidance loop (60, 82) is arranged directly at the outlet side of the thread conveyance roller (6).

* * * * *